US005310109A

United States Patent [19]

Prime et al.

[11] Patent Number: 5,310,109

[45] Date of Patent: May 10, 1994

[54] FOLDED SIMULATED VEHICLE CONTAINER SYSTEM

[76] Inventors: Phillip L. Prime; Cynthia J. Prime, both of 29 Highland Manor Ct., No. Dr., Indianapolis, Ind. 46208

[21] Appl. No.: 877,755

[22] Filed: May 4, 1992

[51] Int. Cl.[5] ..... B65D 5/60

[52] U.S. Cl. ..... 229/8; 206/0.5; 206/457

[58] Field of Search ..... 220/403, 408, 410; 229/8; 206/0.5, 457

[56] References Cited

U.S. PATENT DOCUMENTS

| | | | |
|---|---|---|---|
| 3,552,632 | 1/1971 | Wilson | 206/0.5 |
| 3,557,995 | 1/1971 | Mirasol, Jr. et al. | 229/1.5 B |
| 4,055,250 | 10/1977 | Mayhew | 229/8 |
| 4,208,102 | 6/1980 | Dutcher | 206/5 |
| 4,278,197 | 7/1981 | Scheinbaum et al. | 229/904 |
| 4,497,433 | 2/1985 | Wischusen, III | 229/904 |
| 4,643,349 | 2/1987 | Sheffer | 229/8 |
| 4,646,959 | 3/1987 | Sheffer | 229/8 |
| 4,705,173 | 11/1987 | Forbes, Jr. | 229/904 |
| 4,753,346 | 6/2988 | Tsuji | 206/457 |
| 4,804,133 | 2/1989 | Kiyokane | 229/8 |
| 4,807,802 | 2/1989 | Williams | 229/8 |
| 4,909,391 | 3/1990 | Newarski | 206/457 |
| 4,915,235 | 4/1990 | Roosa | 229/1.5 B |
| 5,044,549 | 9/1991 | Beales | 229/114 |

FOREIGN PATENT DOCUMENTS

| | | | |
|---|---|---|---|
| 613250 | 1/1961 | Canada | 229/8 |
| 904806 | 7/1972 | Canada | 206/457 |
| 484939 | 9/1953 | Italy | 229/8 |

*Primary Examiner*—Gary E. Elkins
*Attorney, Agent, or Firm*—Penrose Lucas Albright

[57] ABSTRACT

A novel decorated simulated vehicle is disclosed that is formed with a cavity adapted snugly to receive a container or other novelty item. The container held within the cavity is also folded cardboard which is formed with a cavity adapted to receive an additional container that is filled with a fragrance bearing substance, such as potpourri. The assembled, folded vehicle is uniquely suitable for promotions, hospitality events, advertising and similar activities.

10 Claims, 8 Drawing Sheets

FOLDED SIMULATED VEHICLE CONTAINER SYSTEM

BACKGROUND OF THE INVENTION

The present invention relates to the field of folded cardboard and paper devices. The device disclosed provides a unique solution for the packaging, display and distribution of fragrance bearing materials, and for articles of novelty.

DISCUSSION OF THE PRIOR ART

The most relevant prior art patents known to the Applicant are as follows: U.S. Pat No. 4,804,133, issued to Kiyokane on Feb. 14, 1989; and U.S. Pat. No. 4,055,250, issued to Mayhew on Oct. 25, 1977. Both of these patents disclose three-dimensional, simulated vehicles that are folded from a sheet of cardboard. Kiyokane shows a compartment within the vehicle used to receive fast food, while Mayhew shows a compartment where multiple products can be displayed.

U.S. Pat. No. 4,643,949, issued to Sheffer on Feb. 17, 1987, and U.S. Pat. No. 4,646,959, also issued to Sheffer, on Mar. 3, 1987, disclose a folded vehicle without an internal compartment.

U.S. Pat. No. 4,450,638, issued to Bader on May 29, 1984, and U.S. Pat. No. 4,885,854, issued to Brandes on Dec. 12, 1989, disclose folded cardboard displays for photographs.

U.S. Pat. No. 1,575,034, issued to Brattain on Mar. 2, 1926, and U.S. Pat. No. 3,325,079, issued to Puckett on Jun. 13, 1967, relate to display cards suitable for receiving packages, bottles, cans, cosmetics, jars, or the like.

U.S. Pat. No. 3,510,974, issued to Lane on May 2, 1970, shows a self-supporting display device formed from a sheet of bendable material.

U.S. Pat. No. 4,887,709, issued to Shimamine on Dec. 19, 1989, discloses a folded package for holding a pair of earrings.

U.S. Design Patent No. 214,262, issued to Paige on May 27, 1969, discloses a collapsible carton in the shape of a vehicle.

SUMMARY OF THE INVENTION

The present invention provides a novel approach to package containment. A unified sheet of cardboard, paper, or the like is cut and stamped to the predetermined shape.

The resulting sheet is then folded in the shape of a vehicle that forms a cavity on the inside. A smaller sheet of cardboard, paper, or other similar material, is cut and fastened together to form a pillow-shaped container. The pillow-shaped container fits snugly inside the cavity of the vehicle.

A fragrance bearing material, such as potpourri or other novelty type objects, may be inserted into the pillow-shaped container. The vehicle is decorated in a sporty fashion, to be suitable for promotions, advertisements, good-will, and the like.

DESCRIPTION OF THE PREFERRED EMBODIMENT

Figure 1:
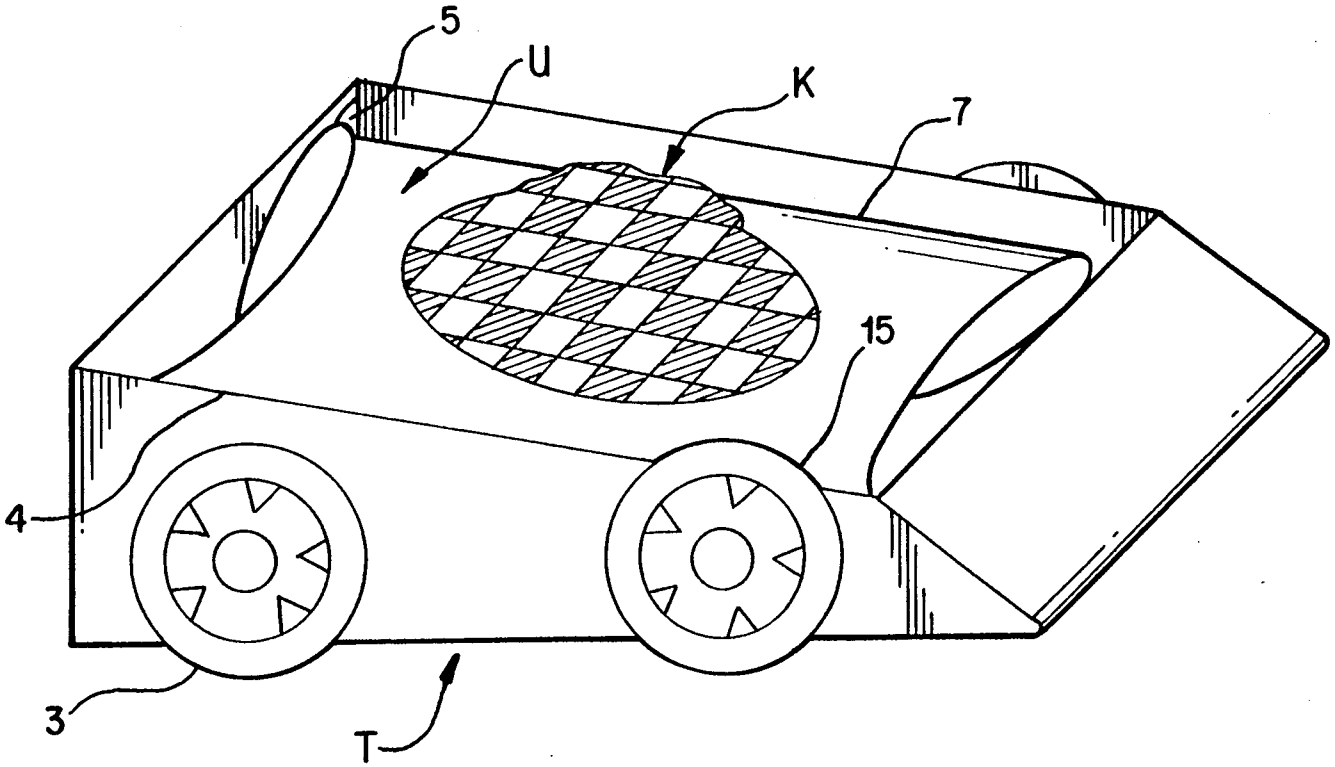
FIG. 1 illustrates a perspective view of the simulated vehicle T including the pillow-shaped container U and the fragrance pod K.

The fully assembled simulated vehicle, including a pillow-shaped container U and a fragrance pod K, is illustrated in FIG. 1.

Figure 3:
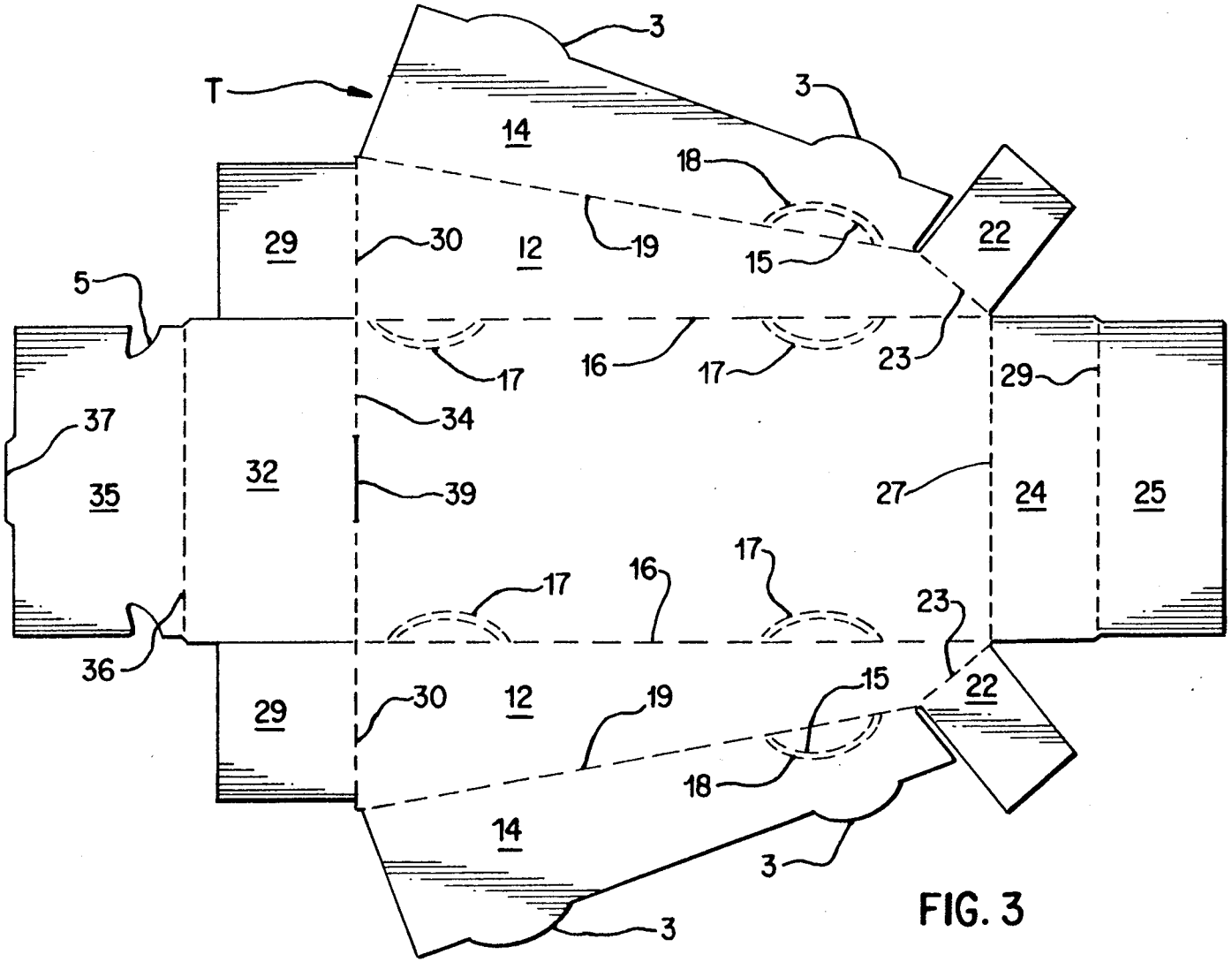
FIG. 3 illustrates a template that is used to cut and form the simulated vehicle.
Figure 4A:
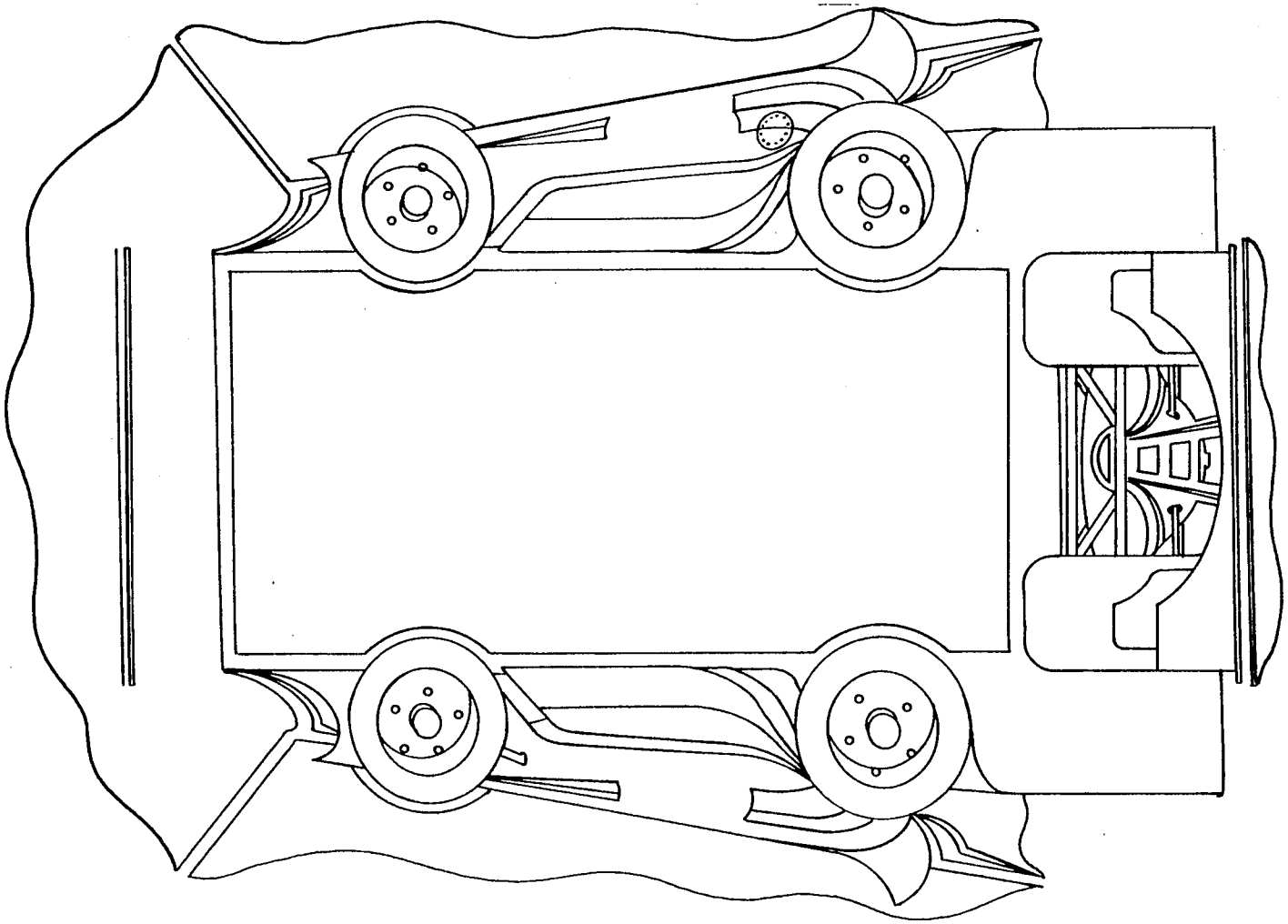
FIGS. 4*a*, 4*b*, 4*c* and 4*d* are representative examples of exterior graphical designs that may be used on the simulated vehicle.
Figure 4B:
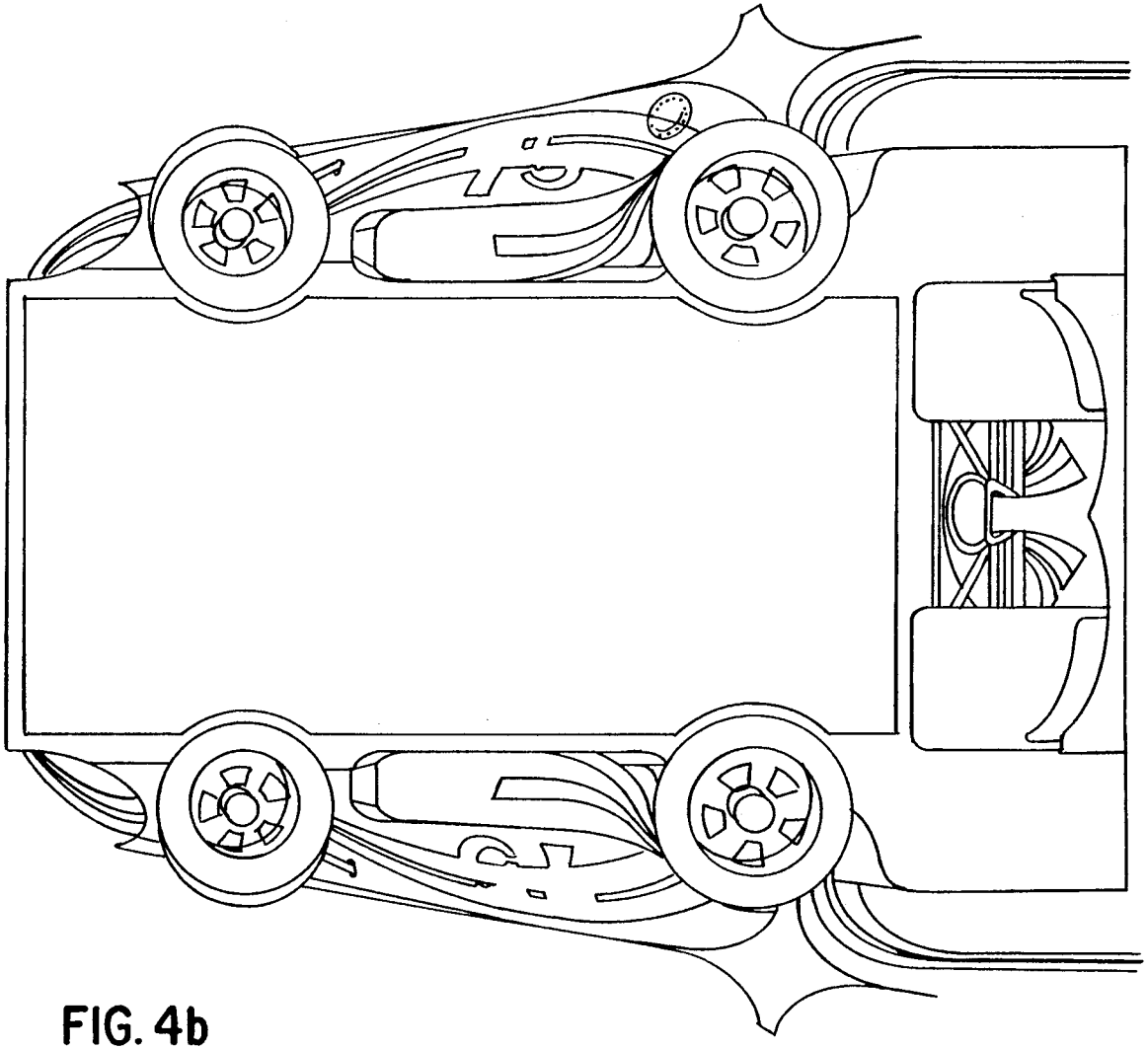
Figure 4C:
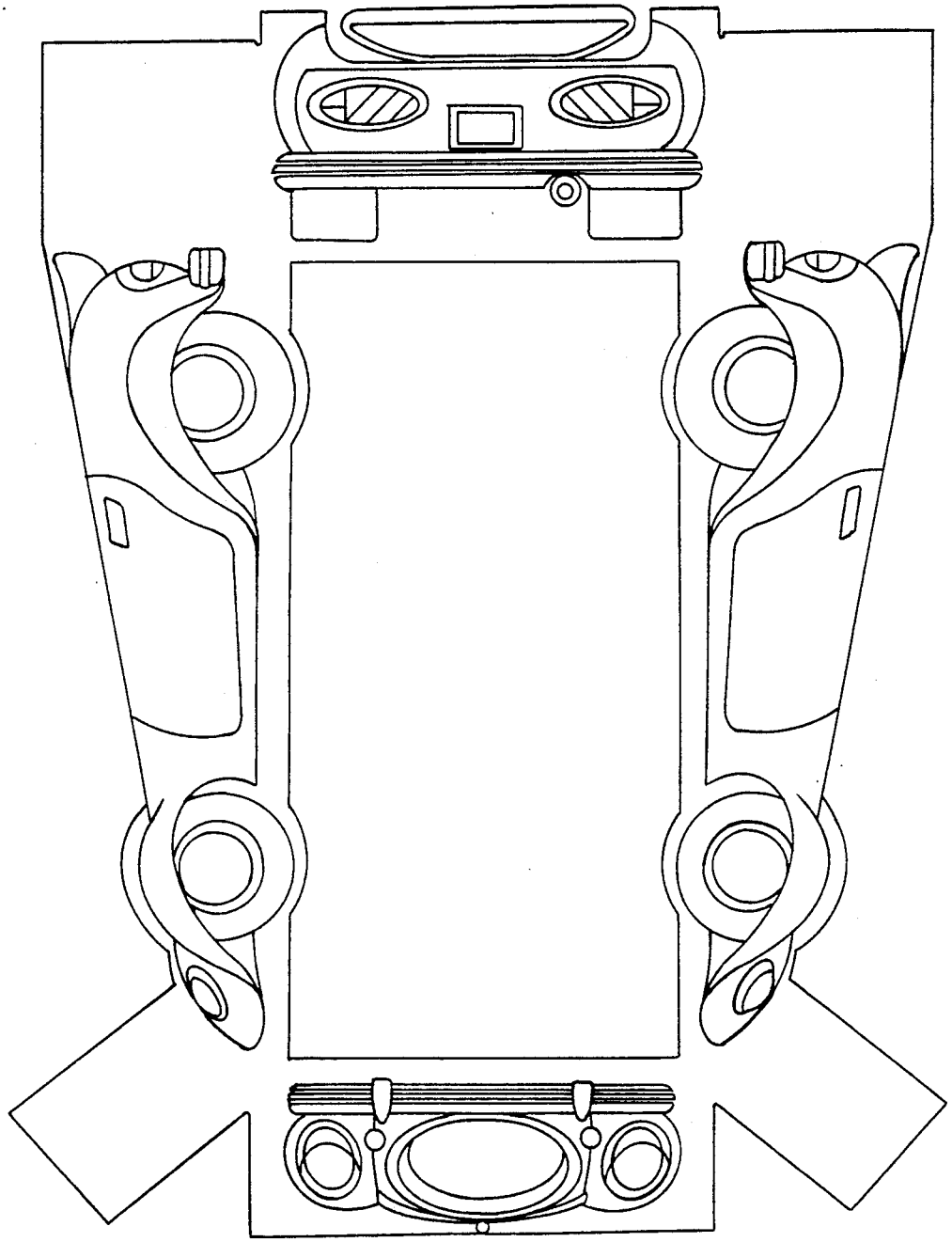
Figure 4D:
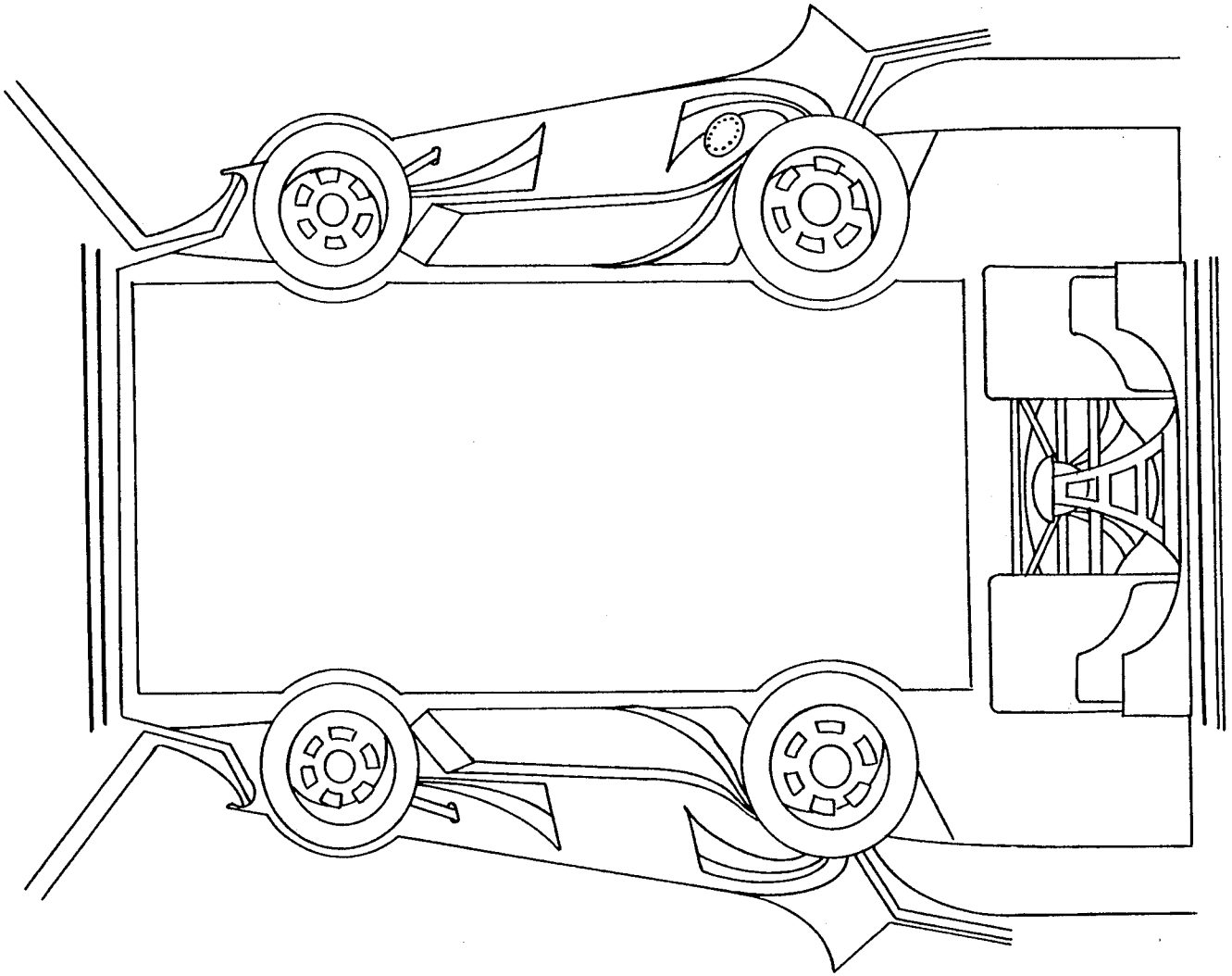

A template as shown in FIG. 3 is utilized to create the simulated vehicle T. Typically, the template is formed from standard 8½"×11" cardboard or other semi-flexible material. The material to be used is cut through at the positions indicated by solid lines, folded at the locations indicated by the single-dashed lines, and is perforated at the locations indicated by the double-dashed lines.

Graphical designs, promotional messages, advertising information or the like, typically, are then embossed or otherwise affixed to the simulated vehicle template. FIGS. 4*a*, 4*b*, 4*c* and 4*d* illustrate four examples of graphical designs that are used on the simulated vehicle template.

Reference is now made to the template shown in FIG. 3.

Assembly of the simulated vehicle is generally accomplished by folding the two sides 12 upward 90° (out of the paper) along line 16; the outer side 14 is then folded inward until the semi-circular tabs 3 engage the mating semi-circular slots 17.

The front end of the simulated vehicle is generally assembled by folding the tabs 22 along line 23 inward toward the center cavity of the simulated vehicle. The inner front section 24 is then folded along line 27 inward toward the center cavity of the simulated vehicle. The outer front section 25 is next folded along line 29 and inserted into the cavity of the simulated vehicle over the tabs 22.

The rear end of the simulated vehicle is generally assembled by first folding tabs, 29 along line 30 inwardly toward the center of the simulated vehicle. The inner rear section 32 is then folded inwardly along line 34 until it is in flush contact with the folded tabs 29. The outer rear section 35 is next folded inwardly along line 36 until the tab 37 engages the slot 39 on the interior of the simulated vehicle.

When fully assembled, as described above, the notches 5 will be positioned in the rear on the interior of the simulated vehicle.

The semi-circular tabs 3 will extend down through slots 17 to form the shape of the lower edge of tires. The simulated vehicle will be supported by these tire tabs 3 as shown in FIG. 1.

The semi-circular tabs 15 extend upwardly from the front fender of the simulated vehicle to form the upper edge of the front tires.

Figure 2:
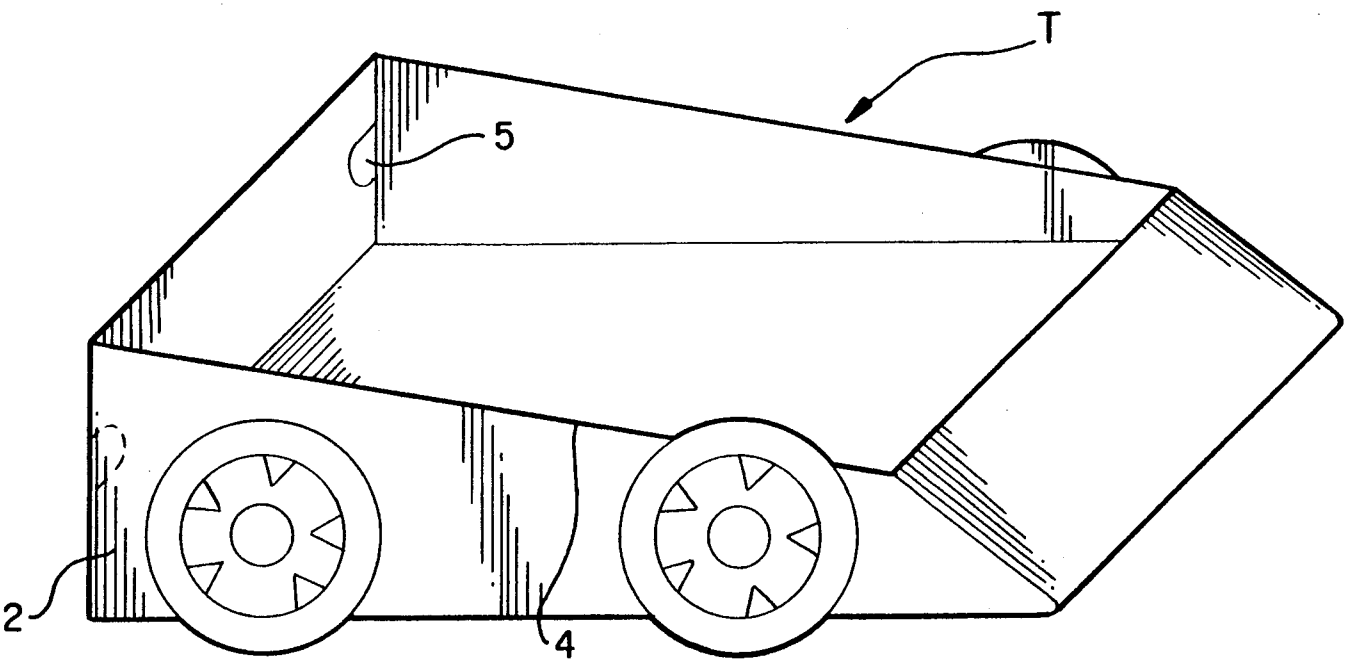
FIG. 2 is a view of the empty, simulated vehicle T.
Figure 2B:
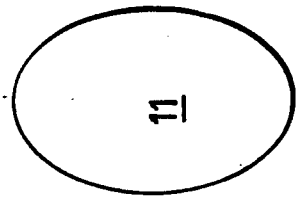
FIG. 2*b* illustrates the end view of the pillow-shaped container U.
Figure 2A:
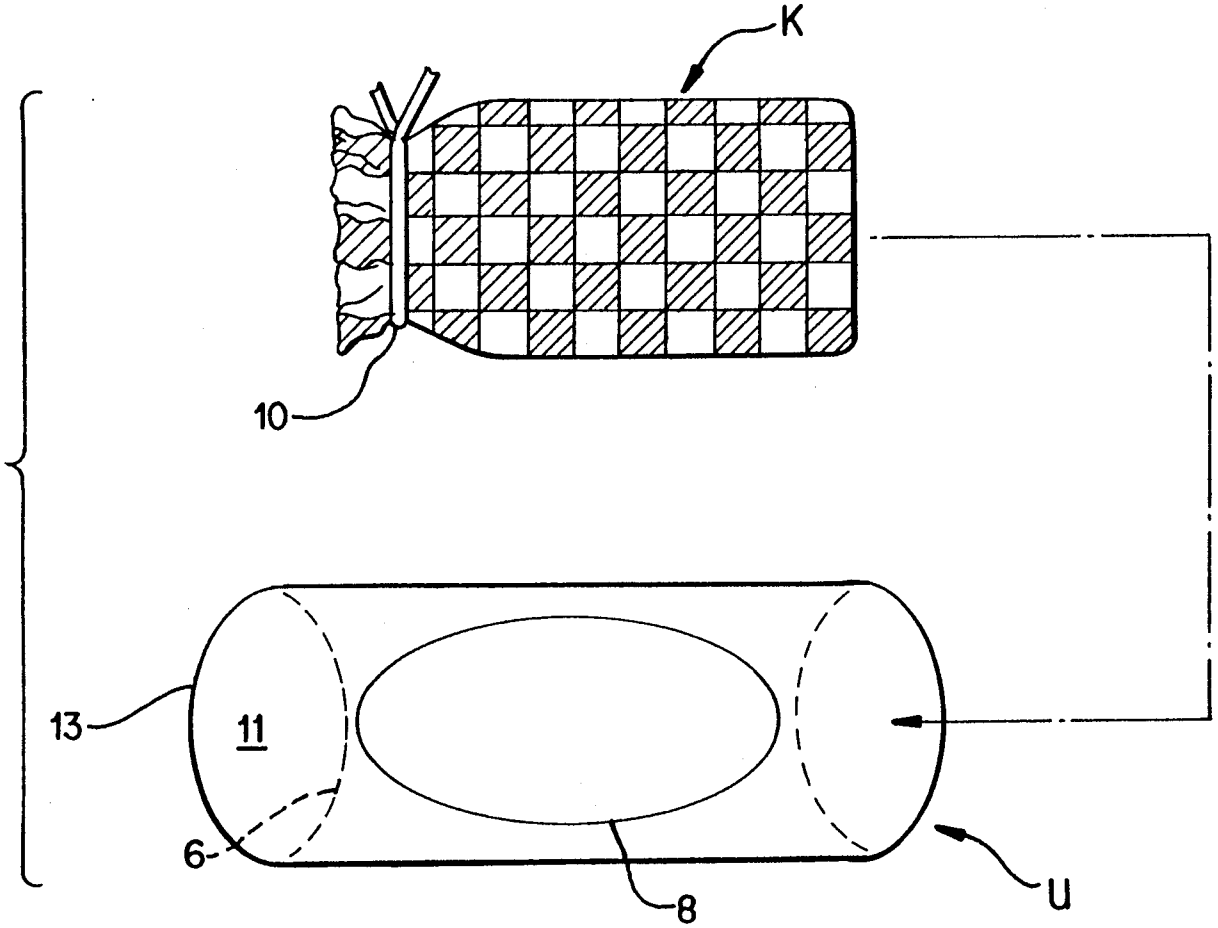
FIG. 2*a* illustrates a pillow-shaped container U and a fragrance pod K.

The container U, to be inserted into the cavity of the simulated vehicle T, is generally pillow-shaped, but other novelty items, such as trophies and the like, are contemplated as being inserted into the internal cavity of the simulated vehicle. The pillow-shaped container U, as shown in FIG. 2*a* and 2*b*, is generally constructed from a single sheet of paper, cardboard, or the like. The outside of the pillow-shaped container U is typically illustrated graphically with marketing messages, publicity, or hospitality messages.

The single sheet is rolled together and connected along the length to form substantially elliptical cross-section as shown in FIG. 2*b*; the ends are cut to form a semi-circular shape 13. The ends of the resulting pillow-shaped container U can be closed by folding tabs 11 inwardly along line 6.

The fragrance pod K, as shown in FIG. 2*a*, is inserted into the pillow-shaped container U, and the tabs 11 on the pillow-shaped container U are then folded closed. The fragrance pod K is typically constructed of a fashionable material that is exposed through the opening 8 in the pillow-shaped container forming a substantially oval surface as illustrated in FIG. 1.

The fragrance pod K contains potpourri, or a similar fragrance bearing material, that is handy for use as a freshener in luggage, drawers, bathrooms, and the like.

When pillow-shaped container U, is inserted into the cavity of the simulated vehicle T, the rear corners of the pillow-shaped container engage the notches 5 of the folded vehicle T. The engagement between the rear corners of the pillow-shape container with the notches 5 of the simulated vehicle and the position of the front corners of the pillow-shaped container result in the parallel alignment of the upper edge 7 of the pillow-shaped container with the upper edge 4 of the simulated vehicle, thereby giving the entire assembly a refined, polished, and attractive appearance, making the invention extremely useful for its intended promotional purpose.

The description given here is intended to illustrate the preferred embodiment of the invention. It is, of course, possible to make various changes to the details of the apparatus without departing from the spirit of this invention.

Having disclosed our invention, what we claim as new and novel and to be secured by Letters Patent of the United States is:

1. A folded receptacle which simulates a vehicle comprising: a piece of semiflexible material folded to form a receptacle in the shape of a simulated vehicle; said receptacle having an upper edge which slopes from the rear to the front, an outside surface, a front, a rear and a first cavity which holds a first container;

said first container is constructed of a semiflexible material and has front corners, rear corners, a top, and a top edge;

said receptacle includes notches formed in said semiflexible material, said notches being positioned to engage the rear corners of said first container, whereby the top edge of said first container is parallel to said upper edge of said receptacle.

2. A simulated vehicle as claimed in claim 1, wherein said first container is constructed of cardboard.

3. A simulated vehicle as claimed in claim 1, wherein said first container is substantially elliptical in cross-section and has an opening on the top.

4. A simulated vehicle as claimed in claim 3, wherein said opening is oval.

5. A simulated vehicle as claimed in claim 4, wherein said first container holds a second container.

6. A simulated vehicle as claimed in claim 5, wherein said second container has a cavity.

7. A simulated vehicle as claimed in claim 6, wherein said second container holds a fragrance emitting material.

8. A simulated vehicle as claimed in claim 6, wherein said second container holds a novelty item.

9. A simulated vehicle as claimed in claim 5, wherein said second container extends out of said opening of said first container forming an oval surface above the top of said first container.

10. A simulated vehicle as claimed in claim 1, wherein said vehicle is decorated on the outside surface to depict a particular model of automobile.

* * * * *